US010872569B2

(12) United States Patent
Meng

(10) Patent No.: US 10,872,569 B2
(45) Date of Patent: Dec. 22, 2020

(54) COMPENSATION METHOD FOR PIXEL CIRCUIT, PIXEL CIRCUIT, AND DISPLAY DEVICE

(71) Applicant: BOE TECHNOLOGY GROUP CO., LTD., Beijing (CN)

(72) Inventor: Song Meng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/452,981

(22) Filed: Jun. 26, 2019

(65) Prior Publication Data

US 2020/0066208 A1 Feb. 27, 2020

(30) Foreign Application Priority Data

Aug. 21, 2018 (CN) ..... 2018 1 0953921

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2300/0809* (2013.01)

(58) Field of Classification Search
CPC ..... G09G 3/3258; G09G 3/3275; G09G 2300/0809
See application file for complete search history.

(56) References Cited

U.S. PATENT DOCUMENTS 8,564,513 B2 * 10/2013 Nathan ..... G09G 3/3233 345/82
2013/0147694 A1 * 6/2013 Kim ..... G09G 3/3233 345/82
2017/0372654 A1 * 12/2017 So ..... G09G 3/2092

* cited by examiner

*Primary Examiner* — Charles V Hicks
(74) *Attorney, Agent, or Firm* — Brooks Kushman P.C.

(57) ABSTRACT

The present disclosure provides a compensation method for pixel circuit, a pixel circuit, and a display device. The pixel circuit includes a data writing circuit, a driving circuit, a sensing circuit, and an energy storage circuit, the compensation method includes: in a charging stage, acquiring a voltage of the second node by the sensing circuit, adjusting a data voltage outputted by the data writing circuit to the first node based on the acquired voltage of the second node, and charging the energy storage circuit by using the adjusted data voltage; and in a compensation stage, compensating characteristic parameters of the driving circuit by the charged energy storage circuit.

7 Claims, 4 Drawing Sheets

COMPENSATION METHOD FOR PIXEL CIRCUIT, PIXEL CIRCUIT, AND DISPLAY DEVICE

CROSS-REFERENCE TO RELATED APPLICATION

This application claims priority to Chinese Patent Application No. 201810953921.8 filed on Aug. 21, 2018, which is incorporated herein by reference in its entirety.

TECHNICAL FIELD

The present disclosure relates to the field of display technology, and in particular to a compensation method for pixel circuit, a pixel circuit, and a display device.

BACKGROUND

In an Active-matrix organic light-emitting diode (AMOLED) display device, variations may occur in parameters such as the threshold voltage, the carrier mobility, and the series resistance in the actual processes of different thin film transistors (TFTs), causing the output characteristics of the TFTs to be inconsistent. Since the current flowing through the OLED has a correlation with the threshold voltage Vth, the current flowing through the OLEDs may vary if the threshold voltages of individual pixels are different, resulting in uneven luminance of the AMOLED display device.

In order to eliminate the above problem of unevenness of luminance and gray-scale accuracy caused by a difference in parameters such as Vth or a change in use of the display device, in the related art, the unevenness characteristics of the TFTs are compensated by a driving circuit, generally by using a compensation mechanism that is implemented by a capacitor Cst and a control circuit composed of transistors.

A pixel drive process including the compensation mechanism typically includes an initialization, a sampling stage, a holding stage, and an irradiation stage. After the initialization is completed, the threshold voltage Vth of the driving transistor is extracted to the storage capacitor Cst; then, the storage capacitor Cst is charged with the data voltage Vdata in the sampling stage, so that the gate-source voltage drop Vgs of the driving transistor is equal to the data voltage. Through the above process, the current flowing through the OLED element in the irradiation stage does not change with the threshold voltage Vth of the driving transistor, but is only related to the data voltage, thereby eliminating the problem that the luminance of the OLED is uneven due to the threshold voltage drift of the driving transistor.

While performing electrical compensation using a pixel circuit as shown in FIG. 3, an ideal charging curve is generally a linear straight line directly related to the data voltage, so that the characteristic parameters of a thin film transistor (TFT) can be reflected accurately so as to eliminate the effect of the Vth component. However, due to the parasitic capacitor between the control terminal of the data writing circuit and the first terminal of the driving circuit, when the control transistor between the data writing circuit and the driving transistor is turned off, there is a capacitive coupling effect, so that the voltage at the first terminal of the driving circuit is not equal to the data voltage, causing errors in extraction and pre-storage of Vth, and thus inaccurate compensation will occur.

As shown in FIG. 1, the horizontal axis is the charging time t, and the vertical axis is the voltage V at the second terminal of the driving circuit in the charging stage. The ideal charging curve is as shown by the first straight line L1. The imperfect curves that may occur in practice may be shown as the second straight line L2, the first curved line Lq1, and the third straight line L3.

In order to make the charging process for Cst as close as possible to the ideal charging curve so as to accurately reflect the characteristic parameters of the driving TFT, the following considerations are generally made in the related art: one method is to reduce the capacitance of the parasitic capacitor by a process, but the capacitance value cannot become 0, which can only reduce but not eliminate the error, i.e., it can only change the charging curve from the third straight line L3 to the second straight line L2; another method is to change the driving waveform, that is, the data writing circuit is not turned off in the entire charging process, so that the gate-source voltage of the driving transistor in the driving circuit will be decreased as the voltage at the second terminal of the driving circuit increases, so the charging curve will be the first curve Lq1 in FIG. 1, which may be charged to a higher level but not linear.

SUMMARY

The present disclosure provides a compensation method for pixel circuit, wherein the pixel circuit includes a data writing circuit, a driving circuit, a sensing circuit, and an energy storage circuit, the data writing circuit is coupled, at a first node, to a first terminal of the driving circuit and a first terminal of the energy storage circuit, the sensing circuit is coupled, at a second node, to a second terminal of the driving circuit and a second terminal of the energy storage circuit, the compensation method includes:

in a charging stage, acquiring a voltage of the second node by the sensing circuit, adjusting a data voltage outputted by the data writing circuit to the first node based on the acquired voltage of the second node, and charging the energy storage circuit by using the adjusted data voltage; and in a compensation stage, compensating characteristic parameters of the driving circuit by the charged energy storage circuit.

Optionally, according to the compensation method of an embodiment of the present disclosure, wherein, in the charging stage, the voltage of the second node is periodically acquired by the sensing circuit with a predetermined time interval, and a sum of the voltage of the second node and a predetermined data voltage is used as the adjusted data voltage to be outputted to the first node by the data writing circuit.

Optionally, according to the compensation method of an embodiment of the present disclosure, wherein the sensing circuit comprises an analog-to-digital converter, and the predetermined time interval is n times of a sampling period of the analog-to-digital converter, wherein n is an integer.

Optionally, according to the compensation method of an embodiment of the present disclosure, wherein the charging stage includes a measurement charging cycle; the step of acquiring a voltage of the second node by the sensing circuit, adjusting the data voltage outputted by the data writing circuit to the first node based on the acquired voltage of the second node includes:

in the measurement charging cycle, outputting a predetermined data voltage to the first node by the data writing circuit, and acquiring the voltage of the second node by the sensing circuit; and determining a measurement charging slope based on the measurement charging cycle and the acquired voltage of the second node, and obtaining the adjusted data voltage according to the determined measurement charging slope.

Optionally, according to the compensation method of an embodiment of the present disclosure, wherein the measurement charging slope is calculated according to the following formula:

$$a=(Vt-V0)/tc;$$

wherein a is the measurement charging slope, Vt is the voltage of the second node at an end of the measurement charging cycle, V0 is the voltage of the second node at a beginning of the measurement charging cycle, and tc is the measurement charging cycle.

Optionally, according to the compensation method of an embodiment of the present disclosure, wherein the adjusted data voltage is calculated according to the following formula:

$$V\text{data}=V\text{data}0+at;$$

wherein Vdata is the adjusted data voltage, Vdata0 is the predetermined data voltage, and a is the measurement charging slope.

Optionally, according to the compensation method of an embodiment of the present disclosure, wherein the energy storage element is a capacitor, and the measurement charging cycle is proportional to a capacitance value of the capacitor.

Optionally, according to the compensation method of an embodiment of the present disclosure, wherein the pixel circuit further includes a resetting circuit, the compensation method further includes a resetting stage before the charging stage, wherein the voltage of the second node is reset by the resetting circuit in the resetting stage.

The present disclosure further provides a pixel circuit including a data writing circuit, a driving circuit, a sensing circuit, and an energy storage circuit, the data writing circuit is coupled, at a first node, to a first terminal of the driving circuit and a first terminal of the energy storage circuit, the sensing circuit is coupled, at a second node, to a second terminal of the driving circuit and a second terminal of the energy storage circuit, wherein the sensing circuit includes an analog-to-digital converter.

Optionally, the pixel circuit according to an embodiment of the present disclosure further includes a resetting circuit for resetting a voltage at the second node.

Optionally, the pixel circuit according to an embodiment of the present disclosure further includes a light emitting element, wherein the first terminal of the driving circuit is a control terminal, the second terminal of the driving circuit is connected to the light emitting element at the second node, and a third terminal of the driving circuit is connected to a supply voltage.

Optionally, according to the pixel circuit of an embodiment of the present disclosure, wherein the pixel circuit is an AMOLED pixel circuit.

The present disclosure further provides a display device including the above pixel circuit.

DETAILED DESCRIPTION

Figure 1:
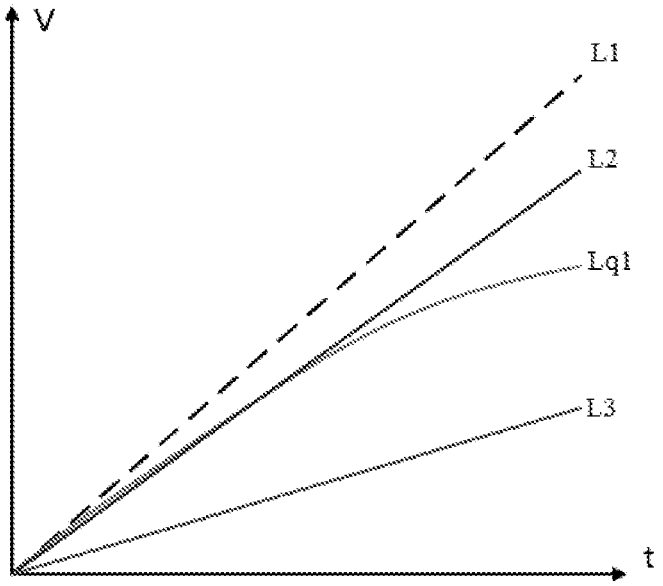
FIG. 1 is a schematic diagram of four charging curves in the related art.
Figure 2:
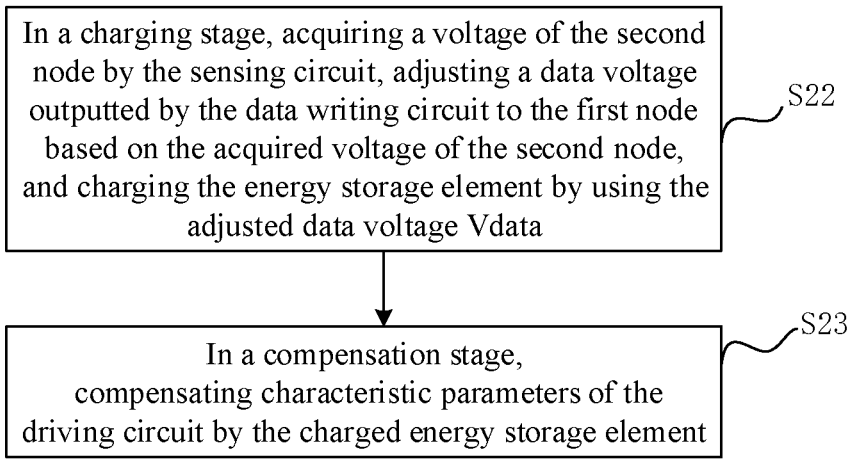
FIG. 2 is a flowchart of a compensation method of a pixel circuit according to an embodiment of the present disclosure.

The technical solutions in the embodiments of the present disclosure are clearly and completely described in the following with reference to the accompanying drawings in the embodiments of the present disclosure. It is obvious that the described embodiments are only a part of the embodiments of the present disclosure, and not all of the embodiments. All other embodiments obtained by one of ordinary skill in the art based on the embodiments of the present disclosure without inventive works fall within the protective scope of the disclosure.

The transistors employed in all embodiments of the present disclosure may each be a thin film transistor or a field effect transistor or other device having the same characteristics. In the embodiments of the present disclosure, in order to distinguish the two electrodes of the transistor except the control electrode, one of the two electrodes is referred to as a first electrode, and the other electrode is referred to as a second electrode. In practice, the control electrode may be a gate electrode, the first electrode may be a drain electrode, and the second electrode may be a source electrode; or the control electrode may be a gate electrode, the first electrode may be a source electrode, and the second electrode may be a drain electrode.

An embodiment of the present disclosure provides a compensation method for pixel circuit, wherein the pixel circuit includes a data writing circuit 21, a driving circuit 22, a sensing circuit 202 and an energy storage circuit 23, the data writing circuit 21 is coupled, at a first node D, to a first terminal of the driving circuit 22 and a first terminal of the energy storage circuit 23, the sensing circuit 202 is coupled, at a second node C, to a second terminal of the driving circuit 22 and a second terminal of the energy storage circuit 23, and the compensation method includes:

S21, in a charging stage, acquiring a voltage of the second node by the sensing circuit 202, adjusting a data voltage outputted by the data writing circuit 21 to the first node based on the acquired voltage of the second node, and charging the energy storage element 23 by using the adjusted data voltage Vdata; and S22, in a compensation stage, compensating characteristic parameters of the driving circuit 22 by the charged energy storage element 23.

The charging curve is an optimized charging curve with high linearity and high accuracy.

According to the compensation method for pixel circuit in the embodiment of the present disclosure, the predetermined data voltage is adjusted by the data writing circuit based on the sampled voltage on the sense line in the charging stage, and the adjusted data voltage are written to the control terminal of the driving circuit. Thereby, the calibration of the charging curve of the storage capacitor Cst is realized, and thus the characteristic parameters of the driving transistor can be accurately reflected so as to perform an accurate compensation.

The characteristic parameters of the driving transistor may be a threshold voltage Vth, a current coefficient K, etc.

The charging curve is a curve of a relationship between the voltage of the second terminal of the driving circuit detected by the sensing circuit and the charging time in the charging stage.

Figure 3:
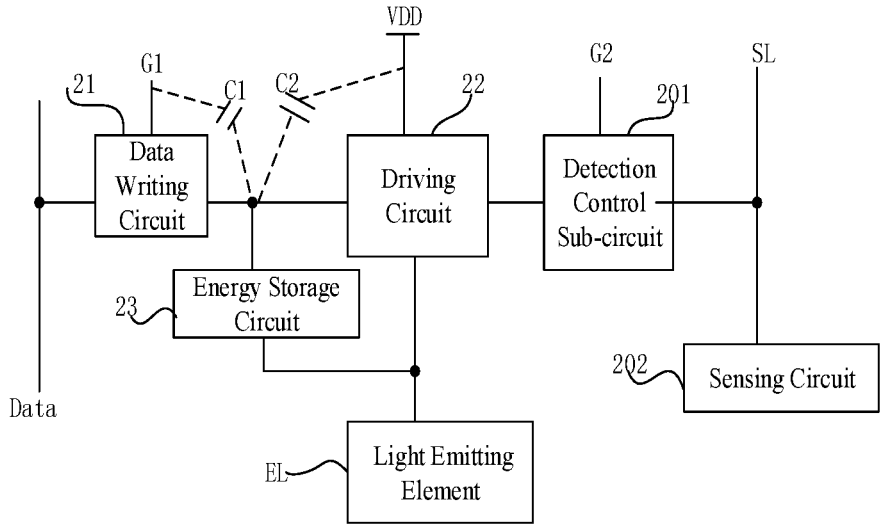
FIG. 3 is a schematic block diagram of a pixel circuit according to an embodiment of the present disclosure.

As shown in FIG. 3, an embodiment of the pixel circuit includes a data writing circuit 21, a driving circuit 22, a sensing circuit 202, an energy storage circuit 23 and a light emitting element EL.

The sensing circuit 202 includes a detection control sub-circuit 201, a detection sub-circuit 202 and a resetting circuit (no shown in FIG. 3). The detection control sub-circuit 201 and the detection sub-circuit 202 are coupled to a sense line SL.

A control terminal of the data writing circuit 21 is coupled to a first scanning line G1. A first terminal of the data writing circuit 21 is coupled to a data line Data, and a second terminal of the data writing circuit 21 is coupled, at a first node D, to the first terminal of the driving circuit 22. The data writing circuit 21 is configured to control, under the control of the first scanning line G1, to write an output voltage from the data line Data to the first terminal (i.e., the first node D) of the driving circuit 22.

The second terminal of the driving circuit 22 is connected, at a second node C, to the light emitting element EL; a third terminal of the driving circuit 22 is coupled to a power supply terminal which is used to input a supply voltage VDD; the driving circuit 22 is configured to drive, under the control of the first terminal thereof, the light emitting element EL to emit light.

A first terminal of the energy storage circuit 23 is connected, at the first node D, to the first terminal of the driving circuit 22, and a second terminal of the energy storage circuit 23 is coupled, at the second node C, to the second terminal of the driving circuit 22.

The detection control sub-circuit 201 is coupled to a second scanning line G2, the second terminal of the driving circuit 22 and the sense line SL, respectively, and is configured to control, under the control of the second scanning line G2, the second terminal of the driving circuit 22 to be electrically connected to the sense line SL.

The detection sub-circuit 202 is coupled to the sense line SL and is used to detect a voltage on the sense line SL.

The resetting circuit (not shown in FIG. 3) is configured to reset a potential of the second terminal of the driving circuit 22 at a predetermined timing.

In a specific implementation, the first terminal of the driving circuit 22 may be a control terminal thereof.

In a practical implementation, as shown in FIG. 3, a parasitic capacitor C1 exists between the control terminal of the data writing circuit 21 and the first terminal of the driving circuit 22, and a parasitic capacitor C2 exists between the first terminal of the driving circuit 22 and the third terminal of the driving circuit 22.

Due to the existence of the parasitic capacitor C1 in FIG. 3, when the data writing circuit 21 turns off the connection between the data line Data and the first terminal of the driving circuit 22, a capacitive coupling effect may occur, which makes the voltage of the first terminal of the driving circuit 22 not equal to the data voltage Vdata output by the data line Data. Thus the characteristic parameters of the driving transistor may be deviated, and inaccurate compensation may be performed.

Figure 4:
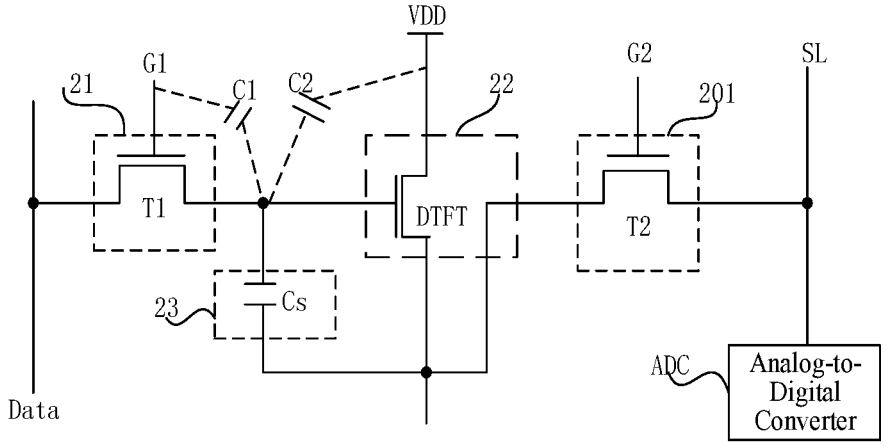
FIG. 4 is an exemplary circuit diagram of a pixel circuit according to an embodiment of the present disclosure.

As shown in FIG. 4, according to the embodiment of the pixel circuit of the present disclosure, the data writing circuit 21 includes a data writing transistor T1, the driving circuit 22 includes a driving transistor DTFT, the detection control sub-circuit 201 includes detection control transistor T2, the detect sub-circuit includes an analog-to-digital converter ADC, the light emitting element includes an organic light emitting diode OLED, and the energy storage circuit 23 includes a storage capacitor Cst;

a gate electrode of T1 is connected to the first scanning line G1, a drain electrode of T1 is connected to the data line Data, and a source electrode of T1 is connected to a gate electrode of DTFT;

a drain electrode of DTFT is connected to the power supply terminal, a source electrode of DTFT is connected to an anode of OLED; a cathode of OLED is connected to the ground GND; the power supply terminal is used to input the supply voltage VDD;

a first terminal of Cst is connected to the gate electrode of DTFT, and the second terminal of Cst is connected to the source electrode of DTFT;

a gate electrode of T2 is connected to the second scanning line G2, a drain electrode of T2 is connected to the source electrode of DTFT, and a source electrode of T2 is connected to the sense line SL.

The analog-to-digital converter ADC is connected to the sense line SL to detect the voltage on SL.

In the embodiment of the pixel circuit as shown in FIG. 4, all of T1, DTFT and T2 are n-type transistors, but not limited thereto.

In the embodiment of FIG. 4, the gate electrode of DTFT is the first terminal of the driving circuit 22, the source electrode of DTFT is the second terminal of the driving circuit 22, and the drain electrode DTFT is the third terminal of the driving circuit 22.

In the embodiment of the pixel circuit as shown in FIG. 4, the first parasitic capacitor C1 is the parasitic capacitor between the gate electrode of T1 and the source electrode of T1, the second parasitic capacitor C2 is the parasitic capacitor between the gate electrode of DTFT and the drain electrode of DTFT.

During operation of the pixel circuit as shown in FIG. 4, due to the presence of the first parasitic capacitor C1, when G1 controls T1 to be switched from on to off, a first scanning voltage output by G1 drops from 24V (volts) to −5V, and the voltage of the gate electrode of DTFT also drop δ volts due to the capacitive coupling effect, wherein $\delta=(24+5)\times C1z/(C1z+C2z+Csz)$, C1z is a capacitance value of the first parasitic capacitor C1, C2z is a capacitance value of the second parasitic capacitor C2, Csz is a capacitance value of Cst. Thus, the charging voltage drop (which is the gate-source voltage Vgs of DTFT) is no longer a value directly related to the data voltage Vdata, and the voltage of the source electrode of DTFT after charging no longer accurately reflects the characteristic parameters of DTFT, causing errors to occur in the extraction and the compensation of the characteristic parameters of DTFT; however, if the characteristic parameters of DTFT is characterized using (Vdata-δ), new variables C1z, C2z, and Csz are introduced, which increases the calculation/design difficulty of the compensation algorithm, and meanwhile, since the above variables C1z, C2z and C3z vary for different pixel circuits on the display panel, this method is not feasible.

In view of this, the method employed in the embodiment of the present disclosure is that, instead of turning off T1, the analog-to-digital converter ADC is used to detect the change in the voltage on SL continuously, or pre-estimate the change in the voltage on the SL in a measurement charging cycle, and then increases the voltage on the data line, so that the gate-source voltage of DTFT is substantially the same as Vdata, and an ideal charging curve is acquired, which avoids the capacitive coupling effect and ensures the linear charging of the sense line SL.

According to the compensation method in some exemplary embodiments of the present disclosure, wherein, in the charging stage, the voltage of the second node C is periodically acquired by the sensing circuit with a predetermined time interval, and a sum of the voltage of the second node C and a predetermined data voltage is used as the adjusted data voltage to be outputted to the first node D by the data writing circuit. Here, the predetermined data voltage refers to an initial data voltage that has not been adjusted or a data voltage signal that is used for actual display, and hereinafter is represented as Vdata0.

Optionally, according to the compensation method in some exemplary embodiments of the present disclosure, the predetermined time interval is n times of a sampling period of the analog-to-digital converter ADC in the sensing circuit, wherein n is an integer. For example, according to the compensation method in an exemplary embodiment of the present disclosure, the acquired voltage (i.e., Vc) of the sensing circuit may be provided to the control circuit according to a sampling period of the analog-to-digital converter ADC or several times of the sampling period, so as to adjust the data voltage outputted by the data writing circuit. As described above, the data writing circuit outputs the sum of the voltage of the sense line (i.e., the voltage Vc at the second node) and the predetermined data voltage Vdata0 as the adjusted data voltage to the first node.

Taking the pixel circuit shown in FIG. 4 as an example, in the charging stage, both G1 and G2 output a high level so that both T1 and T2 are turned on, the analog-to-digital converter ADC detects the voltage on the sense line SL with a predetermined time interval. The voltage on the sense line SL is the voltage Vc at the second node C. Vc and the predetermined data voltage Vdata0 are superimposed together to obtain a superimposed voltage, and the data line is caused to output the superimposed voltage to write the adjusted data voltage into the gate electrode of DTFT. At this time, the adjusted data voltage is equal to the sum of the predetermined data voltage Vdata0 and the voltage Vc of the second node, so that the gate voltage Vg of DTFT is equal to Vdata0+Vc. This can ensure that the gate-source voltage Vgs of DTFT is equal to Vdata0 during the entire charging process, the charging curve is linear and is not affected by the capacitive coupling effect. This method for calibrating the charging curve is accurate, but requires higher speed and accuracy of the ADC.

According to some other embodiments of the present disclosure, the charging stage of the compensation method includes a measurement charging cycle; the step of acquiring a voltage of the second node by the sensing circuit, adjusting the data voltage outputted by the data writing circuit to the first node based on the acquired voltage of the second node includes:

in the measurement charging cycle, outputting a predetermined data voltage Vdata0 to the first node by the data writing circuit, and acquiring the voltage of the second node by the sensing circuit (i.e., the ADC); and determining a measurement charging slope based on the measurement charging cycle and the acquired voltage of the second node, and acquiring the adjusted data voltage according to the determined measurement charging slope.

Figure 5:
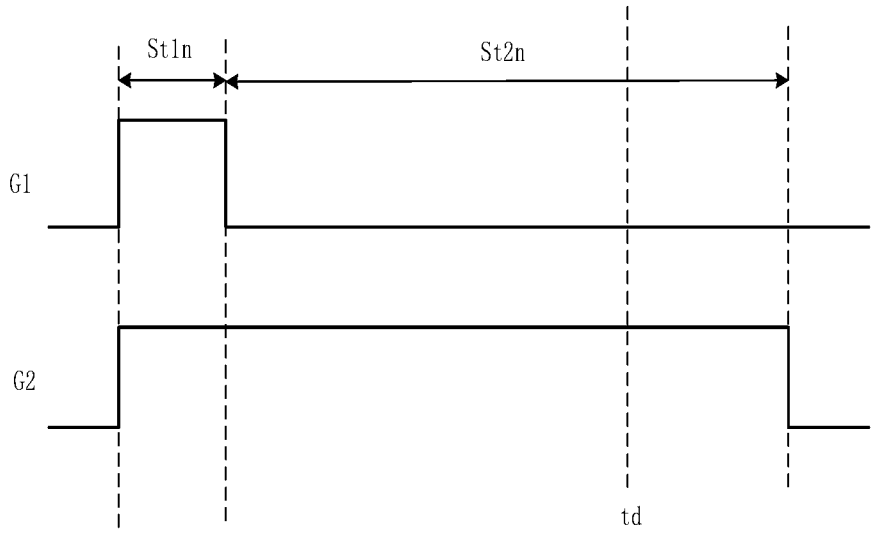
FIG. 5 is an exemplary timing chart of a compensation method of a pixel circuit according to an embodiment of the present disclosure.
Figure 6:
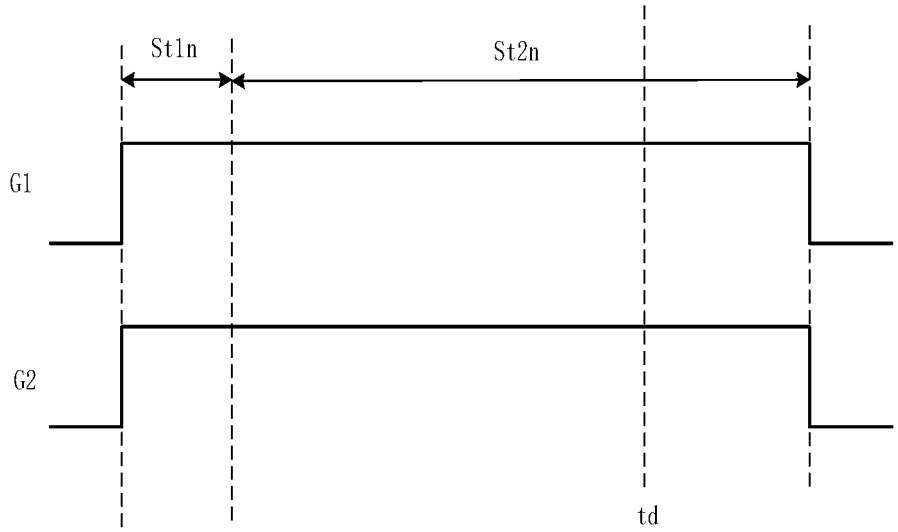
FIG. 6 is another exemplary timing chart of a compensation method of a pixel circuit according to an embodiment of the present disclosure.
Figure 7:
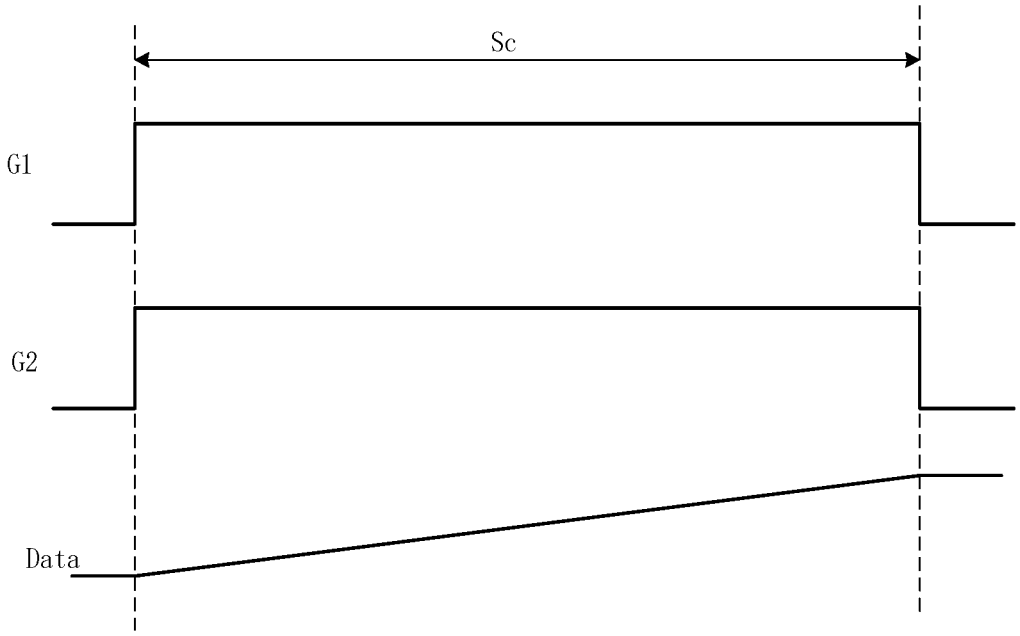
FIG. 7 is an exemplary timing chart of a data voltage adjusting process of a compensation method of a pixel circuit according to an embodiment of the present disclosure.

As shown in FIG. 5, at the beginning of the charging stage, the above measurement charging cycle is started so as to reset the source voltage of DTFT to the initial voltage; meanwhile, G1 provides a high level and G2 provides a low level so that both T1 and T2 are turned on, and the predetermined data voltage Vdata0 is written into the gate electrode of DTFT. Then, at the ending of the preset measurement charging cycle, G1 outputs a low level and G2 outputs a high level, so that T1 is turned off and T2 is turned on, and the voltage on the sense line SL, i.e., the voltage Vt at the second node C, is detected by the ADC.

The measurement charging slope is calculated according to the following formula:

$$a=(Vt-V0)/tc;$$

wherein a is the measurement charging slope, Vt is the voltage of the second node at the end of the measurement charging cycle, V0 is the voltage of the second node at the beginning of the measurement charging cycle, and tc is the measurement charging cycle.

According to some embodiments of the present disclosure, the above energy storage element is a capacitor, and the time length of the measurement charging cycle is proportional to a capacitance value of the capacitor. For example, if the capacitance value of the storage capacitor Cst is small, the measurement charging cycle is set to be short; on the contrary, if the capacitance value of the storage capacitor Cst is great, the measurement charging cycle is set to be long.

By using the predetermined data voltage Vdata0 to perform charging and detection in the above measurement charging cycle, the measurement charging slope a may be obtained. The slope a may represent a rising rate of the charging curve. After the above measurement charging cycle is completed, the slope value may be used to adjust the predetermined data voltage in the entire subsequent charging stage so as to obtain an approximately ideal charging curve.

According to the compensation method of some embodiments of the present disclosure, the above adjusted data voltage may be determined according to the following formula:

$$V\text{data}=V\text{data}0+at;$$

wherein Vdata is the adjusted data voltage, Vdata0 is the predetermined data voltage, and a is the measurement charging slope.

It can be seen that, in the charging stage, after the above measurement charging cycle is completed, the adjusted data voltage Vdata is equal to a value obtained by adding a corresponding voltage value to the predetermined data voltage Vdata0 every a certain time. Since the measurement charging slope a obtained by measuring may be approximately equal to the rising rate of the voltage at the second node during the charging process, the above adjusted data voltage Vdata causes the gate voltage Vg of DTFT to be equal to Vdata0+at, that is, which ensures that the gate-source voltage Vgs of DTFT is approximately equal to Vdata0 during the entire charging process, and causing the charging process to conform to the ideal curve substantially.

Meanwhile, such method for calibrating the charging curve is easy to achieve, has a relatively low requirement for the detection accuracy of the sense line voltage, thereby providing improved compensation accuracy at a lower cost.

The present disclosure further provides a pixel circuit which includes a data writing circuit 21, a driving circuit 22, a sensing circuit 202, and an energy storage circuit 23, the data writing circuit 21 is coupled, at a first node D, to a first terminal of the driving circuit 22 and a first terminal of the energy storage circuit 23, the sensing circuit 202 is coupled, at a second node C, to a second terminal of the driving circuit 22 and a second terminal of the energy storage circuit 23.

Optionally, the sensing circuit includes an analog-to-digital converter ADC.

Optionally, the pixel circuit according to an embodiment of the present disclosure further includes a resetting circuit for resetting the voltage at the second node.

Optionally, the pixel circuit according to an embodiment of the present disclosure further includes a light emitting element EL, wherein the first terminal of the driving circuit 22 is a control terminal of the light emitting element EL, the second terminal of the driving circuit 22 is connected to the light emitting element EL at the second node, and a third terminal of the driving circuit 22 is connected to a supply voltage VDD.

Optionally, the pixel circuit according to an embodiment of the present disclosure, the pixel circuit is an AMOLED pixel circuit.

The display device provided by the embodiment of the present disclosure may be any product or component having a display function, such as a mobile phone, a tablet, a television, a display, a notebook computer, a digital photo frame, a navigator, and the like.

The above are merely the preferable implementations of the present disclosure. It should be noted that, one of ordinary skill in the art may make various modifications and improvements without departing from the principle of the present disclosure, and these modifications and improvements should also be considered as the protective scope of the present disclosure.

What is claimed is:

1. A compensation method for pixel circuit, wherein the pixel circuit comprises a data writing circuit, a driving circuit, a sensing circuit, and an energy storage circuit, the data writing circuit is coupled, at a first node, to a first terminal of the driving circuit and a first terminal of the energy storage circuit, the sensing circuit is coupled, at a second node, to a second terminal of the driving circuit and a second terminal of the energy storage circuit, the compensation method comprising:

in a charging stage, acquiring a voltage of the second node by the sensing circuit, adjusting a data voltage outputted by the data writing circuit to the first node based on the acquired voltage of the second node, and charging the energy storage circuit by using the adjusted data voltage; and in a compensation stage, compensating characteristic parameters of the driving circuit by the charged energy storage circuit, wherein the charging stage comprises a measurement charging cycle; and the step of acquiring a voltage of the second node by the sensing circuit, adjusting the data voltage outputted by the data writing circuit to the first node based on the acquired voltage of the second node comprises:

in the measurement charging cycle, outputting a predetermined data voltage to the first node by the data writing circuit, and acquiring the voltage of the second node by the sensing circuit; and determining a measurement charging slope based on the measurement charging cycle and the acquired voltage of the second node, and obtaining the adjusted data voltage according to the determined measurement charging slope.

2. The compensation method according to claim 1, wherein, in the charging stage, the voltage of the second node is periodically acquired by the sensing circuit with a predetermined time interval, and a sum of the voltage of the second node and a predetermined data voltage is used as the adjusted data voltage to be outputted to the first node by the data writing circuit.

3. The compensation method according to claim 2, wherein the sensing circuit comprises an analog-to-digital converter, and the predetermined time interval is n times of a sampling period of the analog-to-digital converter, wherein n is an integer.

4. The compensation method according to claim 1, wherein the measurement charging slope is calculated according to the following formula:

$$a=(Vt-V0)/tc;$$

wherein a is the measurement charging slope, Vt is the voltage of the second node at an end of the measurement charging cycle, V0 is the voltage of the second node at a beginning of the measurement charging cycle, and tc is the measurement charging cycle.

5. The compensation method according to claim 4, wherein the adjusted data voltage is calculated according to the following formula:

$$\text{Vdata}=\text{Vdata0}+at;$$

wherein Vdata is the adjusted data voltage, Vdata0 is the predetermined data voltage, and a is the measurement charging slope.

6. The compensation method according to claim 1, wherein the energy storage element is a capacitor, and the measurement charging cycle is proportional to a capacitance value of the capacitor.

7. The compensation method according to claim 1, wherein the pixel circuit further comprises a resetting circuit, the compensation method further comprises a resetting stage before the charging stage, wherein the voltage of the second node is reset by the resetting circuit in the resetting stage.

* * * * *